US009205537B2

(12) United States Patent
Chang

(10) Patent No.: US 9,205,537 B2
(45) Date of Patent: Dec. 8, 2015

(54) DETACHABLE RATCHET WRENCH

(71) Applicant: Chih-Min Chang, Xiushui Township, Changhua County (TW)

(72) Inventor: Chih-Min Chang, Xiushui Township, Changhua County (TW)

( * ) Notice: Subject to any disclaimer, the term of this patent is extended or adjusted under 35 U.S.C. 154(b) by 239 days.

(21) Appl. No.: 13/927,705

(22) Filed: Jun. 26, 2013

(65) Prior Publication Data

US 2014/0053690 A1 Feb. 27, 2014

(30) Foreign Application Priority Data

Aug. 23, 2012 (TW) ..... 101216261 U

(51) Int. Cl.
*B25B 13/46* (2006.01)
*B25B 13/04* (2006.01)
*B25B 13/08* (2006.01)

(52) U.S. Cl.
CPC ..... *B25B 13/461* (2013.01); *B25B 13/04* (2013.01); *B25B 13/08* (2013.01); *B25B 13/463* (2013.01)

(58) Field of Classification Search
CPC .... B25B 13/461; B25B 13/463; B25B 13/04; B25B 13/08
See application file for complete search history.

(56) References Cited

U.S. PATENT DOCUMENTS

| | | | | |
|---|---|---|---|---|
| 5,074,174 | A * | 12/1991 | Kim | 81/185 |
| 6,408,722 | B1 * | 6/2002 | Chen | 81/60 |
| 6,527,404 | B2 * | 3/2003 | Wang | 362/119 |
| 6,904,832 | B1 * | 6/2005 | Chen | 81/63.2 |
| 8,113,092 | B2 * | 2/2012 | Lee | 81/63 |
| 8,186,247 | B1 * | 5/2012 | Chen | 81/60 |
| 8,485,069 | B1 * | 7/2013 | Chen | 81/63 |
| 2012/0036967 | A1 * | 2/2012 | Hsu | 81/62 |
| 2012/0060652 | A1 * | 3/2012 | Gapp et al. | 81/58.2 |
| 2012/0192683 | A1 * | 8/2012 | Chen | 81/62 |
| 2012/0291594 | A1 * | 11/2012 | Li et al. | 81/60 |
| 2013/0180366 | A1 * | 7/2013 | Wu et al. | 81/63.1 |

FOREIGN PATENT DOCUMENTS

| | | |
|---|---|---|
| TW | M311536 | 5/2007 |

* cited by examiner

*Primary Examiner* — David B Thomas
(74) *Attorney, Agent, or Firm* — Muncy, Geissler, Olds & Lowe, P.C.

(57) ABSTRACT

A detachable ratchet wrench spanner made accordance with the present invention includes a spanner body, a ratchet gear, a retaining collar, and a locking device. The spanner body includes a first surface, a second surface, and a through hole extending from the first surface to the second surface, and an annual recess defined within an inner wall of the through hole. A ratchet gear is rotationally disposed within the through hole. And a retaining collar is attached to a first opening of the through hole located on the first surface. The retaining collar includes a blocking ring and an anchor and a retainer extending from the blocking ring, wherein the blocking ring is located within the through hole, and the anchor is disposed within the annual recess of the spanner body, and the retainer is engaged to the spanner body with a locking device.

9 Claims, 9 Drawing Sheets

DETACHABLE RATCHET WRENCH

BACKGROUND OF THE INVENTION

1. Field of the Invention

The present invention relates generally to a ratchet wrench and more particularly, to a detachable ratchet wrench.

2. Description of Related Art

As disclosed in Taiwan Patent No. M311536, a conventional ratchet wrench includes a main body, a ratchet rotatable mounted to a through hole of the main body, an annular cover for preventing the ratchet from disengagement from the main body, a pawl, and a springy member, the latter two of which are mounted inside a chamber of the main body. The pawl is engaged with the ratchet and can limit the ratchet to rotation toward to a particular direction, such as clockwise or counterclockwise.

The annular cover of the aforesaid ratchet wrench includes an annular groove recessed inwardly from an external periphery thereof. The main body also includes an annular groove recessed from the wall of the through hole. The annular cover is fixed to the main body via two C-shaped retaining rings mounted inside the annular grooves, respectively. After the assembly of the ratchet wrench is finished, the C-shaped retaining rings are hidden inside the main body, so it is difficult for a common user to dismantle it from the main body.

In this way, when a foreign matter enters the chamber of the ratchet wrench to result in non-smooth rotation or either of the components is damaged to lead to malfunction of the ratchet wrench, the user fails to dismantle the ratchet wrench on his or her own to remove the foreign matter, repair or replace the damaged component. Briefly, the conventional ratchet wrench is still defective to need further improvement.

SUMMARY OF THE INVENTION

The primary objective of the present invention is to provide a detachable ratchet wrench, which allows the user to dismantle it for cleaning, repairing, or replacement of damaged parts.

The foregoing objective of the present invention is attained by the detachable ratchet wrench composed of a main body, a ratchet, a cover member, and a fastening unit. The main body includes a first surface, a second surface, a through hole running through the first and second surfaces, and a groove recessed from the wall of the through hole. The ratchet is mounted inside the through hole. The cover member is mounted to an opening located at the first surface and formed from the through hole for limiting the ratchet into the through hole. The cover member includes a block portion, a retained portion, and a fixed portion. The retained portion and fixed portion protrude from the block portion. The block portion is located at the through hole. The retained portion is mounted inside the groove of the main body. The fixed portion is fixedly connected with the main body via the fastening unit.

The retained portion is limited to the groove and the fixed portion is fixed to the main body, so the cover member can be stably mounted to the main body to prevent the ratchet from disengagement from the main body. Besides, the user can easily dismantle the fastening unit to further dismantle the ratchet wrench for cleaning, repairing, or replacing one or more components.

BRIEF DESCRIPTION OF THE DRAWINGS

Structural features and desired effects of the detachable ratchet wrench of the present invention will become more fully understood by reference to four preferred embodiments given hereunder.

DETAILED DESCRIPTION OF PREFERRED EMBODIMENTS

Figure 1:
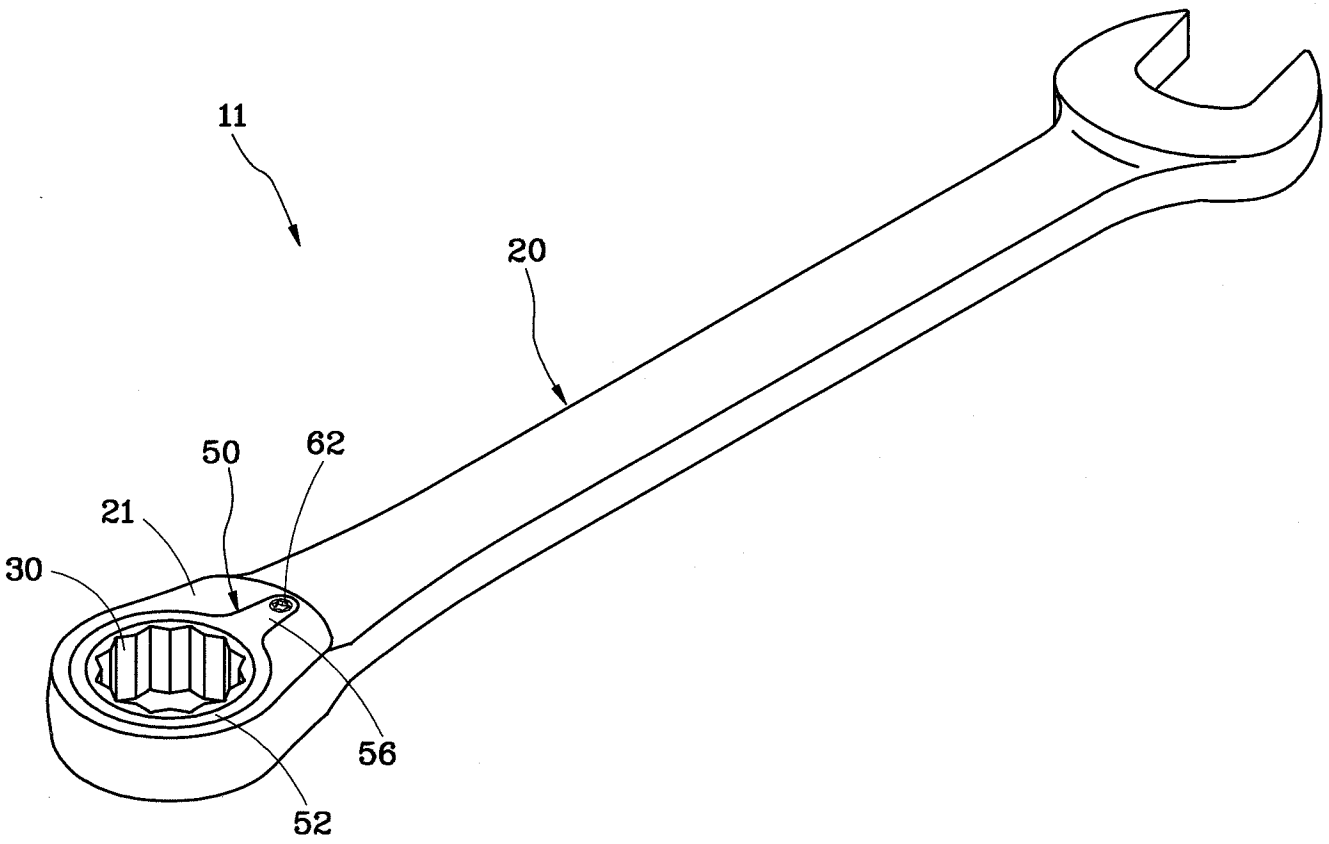
FIG. 1 is a perspective view of a first preferred embodiment of the present invention.
Figure 2:
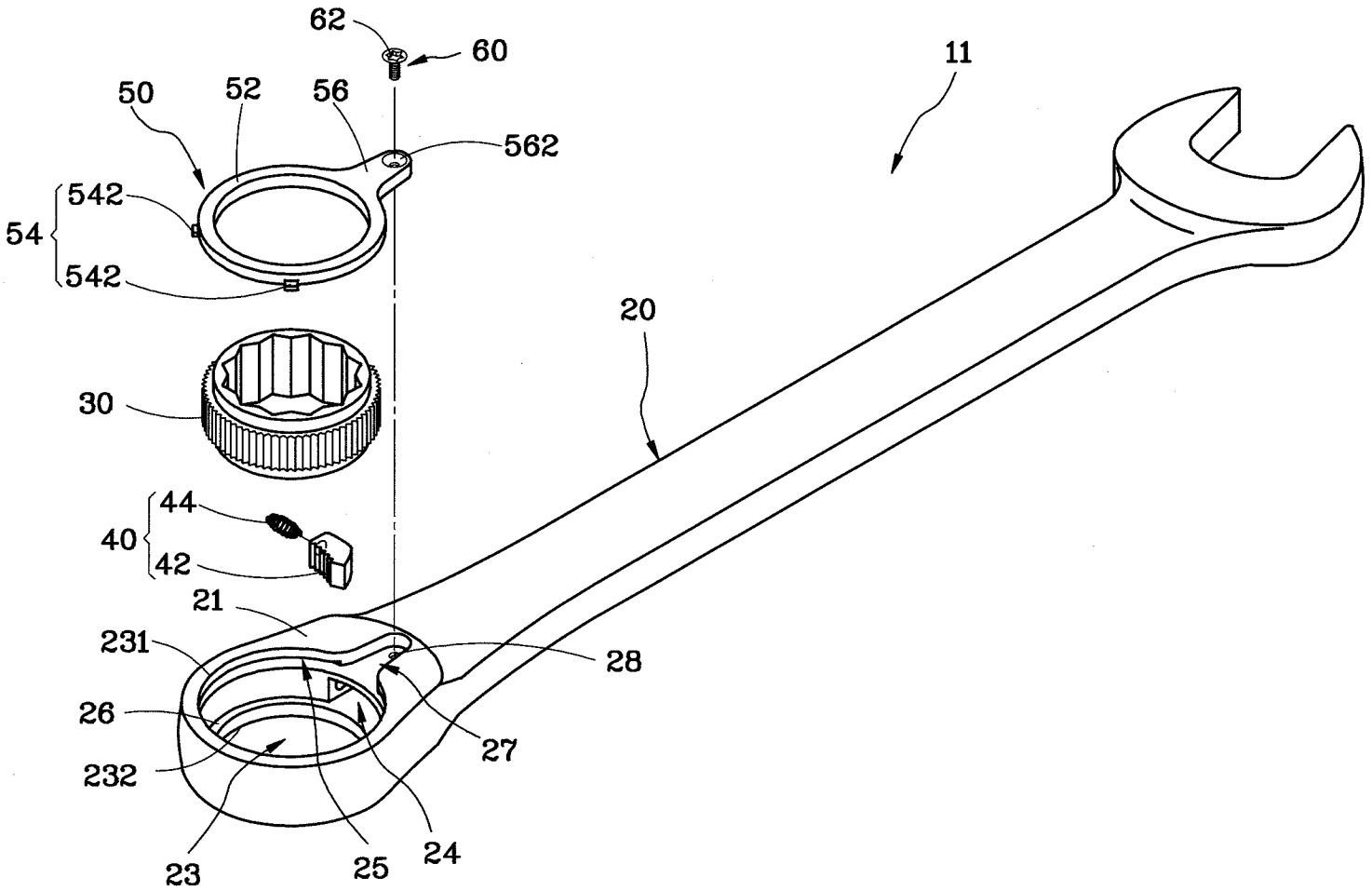
FIG. 2 is an exploded view of the first preferred embodiment of the present invention.

First of all, it is to be noted that the same reference numerals in the following preferred embodiments and drawings indicate the same or similar components or structural features.

Referring to FIGS. 1-4, a detachable ratchet wrench 11 is composed of a main body 20, a ratchet 30, a detent assembly 40, a cover member 50, and a fastening unit 60. The detailed descriptions and operations of these elements as well as their interrelations are recited in the respective paragraphs as follows.

The main body 20 is similar to that of the conventional ratchet wrench, having two ends, one of which includes a first surface 21, a second surface 22, a through hole 23 running through the first and second surfaces 21 and 22, and an accommodation chamber 24 recessed from a sidewall of the through hole 23, and a groove 25 recessed from the wall of the through hole 23. The through hole 23 is provided with two openings 231 and 232 located at the first and second surfaces 21 and 22, respectively. The through hole 23 is further provided with a stepped portion formed on the wall thereof and close to the opening 232 and serving as a retaining portion 26. The main body 20 further includes a recession 27 and a threaded hole 28 as a difference from the prior art. The recession 27 is recessed from the first surface 21 and communicates with the through hole 23. The threaded hole 28 is mounted inside the recession 27.

The ratchet 30 and the detent assembly 40 are identical to those of the prior art. The ratchet 30 is mounted inside the through hole 23. The detent assembly 40 is mounted inside the accommodation chamber 24 and includes a pawl 42 engaged with the ratchet 30, and a springy member 44 abutting against between the pawl 42 and the main body 20 in such a way that the detent assembly 40 can limit the ratchet 30 to one-way rotation.

The cover member 50 is mounted to the opening 231 of the through hole 23 of the main body 20 and fixedly connected with the main body 20 to enable the ratchet 30 to be limited into the through hole 23 by the retaining portion 26 and the cover member 50.

Furthermore, the cover member 50 includes an annular block portion 52, a retained portion 54 protruding outward from the block portion 52, and a fixed portion 56 protruding outward from the block portion 52, and a through hole 562 formed at the fixed portion 56. The fastening unit 60 includes a screw bolt 62. When it is intended to mount the cover member 50 and the fastening unit 60 into the groove 25, the user can mount the retained portion 54 into the groove 25, then mount the block portion 52 into the through hole 23 to block a part of the ratchet 30, meanwhile, make the fixed portion 56 be located inside the recession 27, and finally insert the screw bolt 62 through the through hole 562 in such a way that the screw bolt 62 can be threaded with the threaded hole 28.

In this way, the user only needs to detach the screw bolt 62 from the main body 20 and the cover member 50 to easily dismantle the ratchet wrench 11 for further cleaning, repairing, or replacing one or more components.

Figure 5:
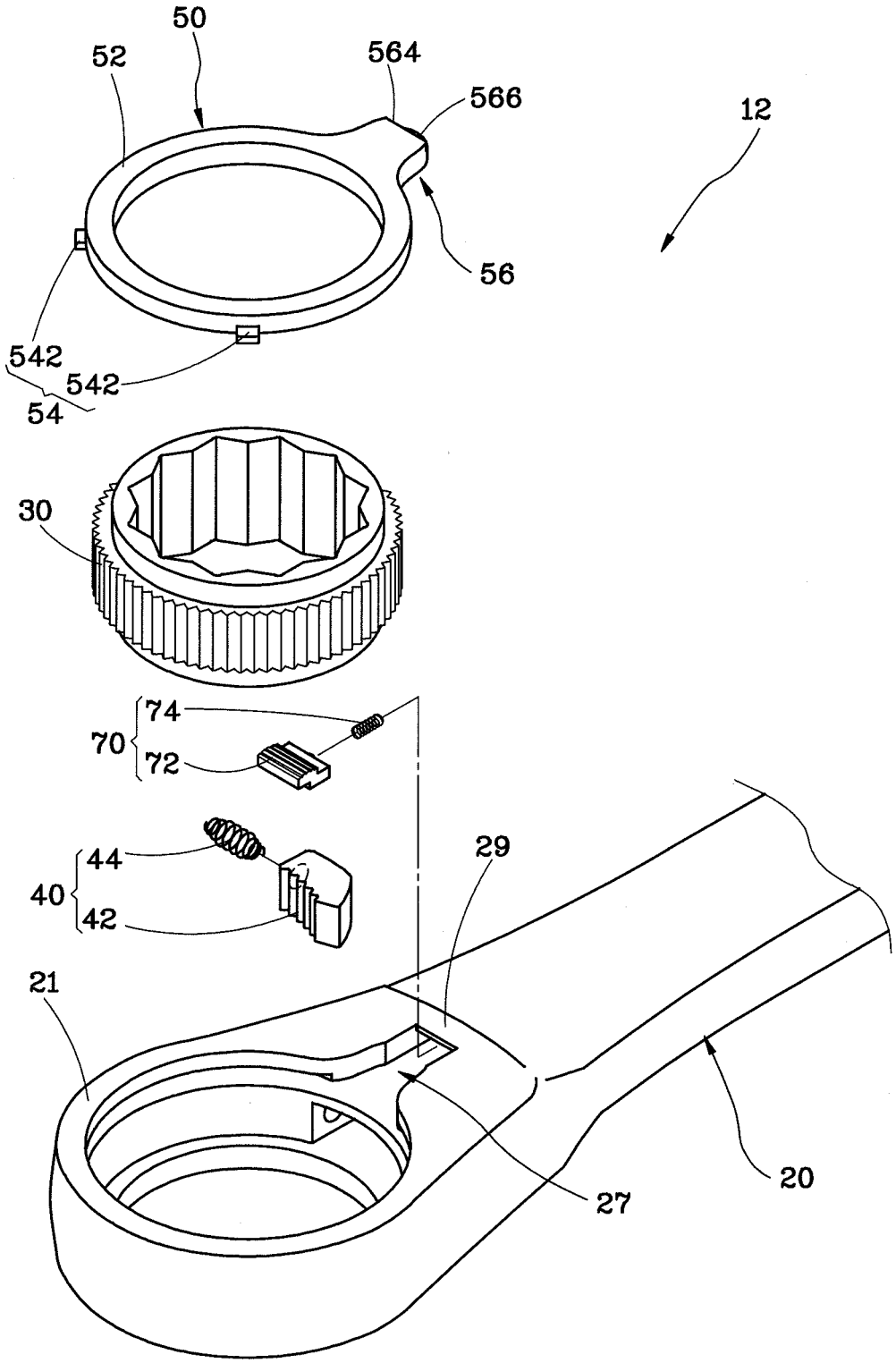
FIG. 5 is an exploded view of a second preferred embodiment of the present invention.
Figure 6:
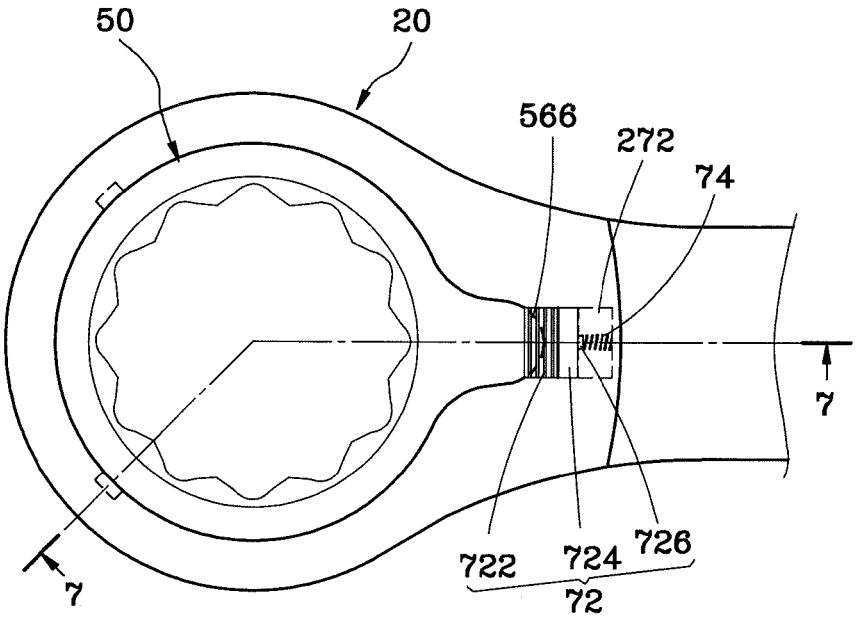
FIG. 6 is a partially top view of the second preferred embodiment of the present invention.
Figure 7:
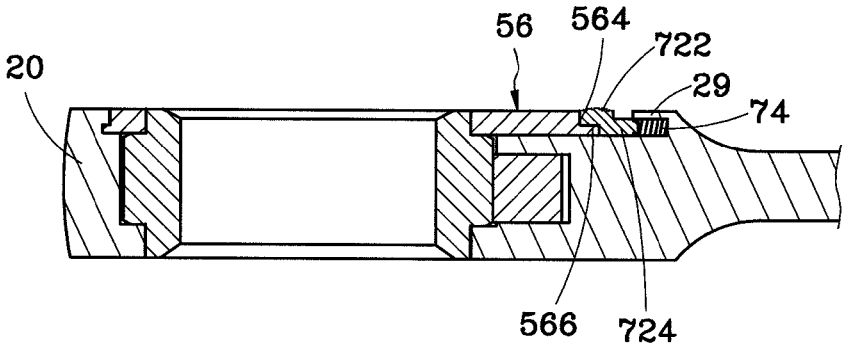
FIG. 7 is a sectional view taken along a line 7-7 indicated in FIG. 6.

Referring to FIGS. 5-7, a detachable ratchet wrench 12 constructed according to a second preferred embodiment of the present invention is similar to that of the first embodiment, having the following differences set forth the following paragraphs.

The main body 20 includes a cover portion 29 covering a part of the recession 27 in such a way that a semi-closed receiving portion 272 is formed at the recession 27 and below the first surface 21.

Figure 8:
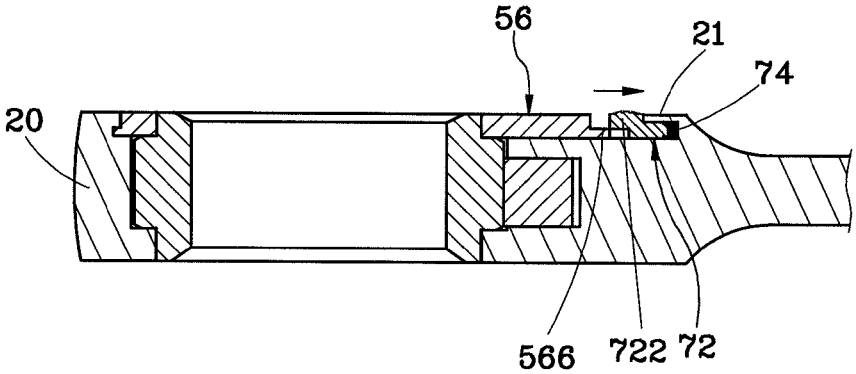
FIG. 8 similar to FIG. 7 illustrates that a pusher is pushed toward a springy member.

The fixed portion 56 of the cover member 50 includes a contacting surface 564 facing the receiving portion 272, and a contacting portion 566 extending outward from the contacting surface 564 in such a way that the fixed portion 56 becomes stepped, as shown in FIGS. 7-8.

The fastening unit 70 includes a pusher 72 and a springy member 74. The pusher 72 has a first push portion 722 and a second push portion 724 connected with the first push portion 722 in such a way that the pusher 72 becomes stepped, as shown in FIGS. 7-8. The pusher has two ends, one of which is located at the first push portion 722 and abuts against the contacting surface 564 and the other is located at the second push portion 724 and protrudes outward to form a protrusion 726, as shown in FIG. 6. The first push portion 722 is located on the contacting portion 566. The springy member 74 is sleeved onto the protrusion 726 and mounted inside the receiving portion 272, having two ends abutting against the second push portion 724 and the main body 20, respectively. The second push portion 724 abuts against the contacting portion 566.

The fastening unit 70 can stably fasten the fixed portion 56 to the main body 20 and the user only needs to push the pusher 72 toward the springy member 74, as shown in FIG. 8, to stop the pusher 72 from abutting against the fixed portion 56 any longer and in this way, the first portion 722 is no longer located on the contacting portion 566, so the cover member 50 can be removed from the main body 20 and the ratchet wrench 12 can be further dismantled.

Figure 3:
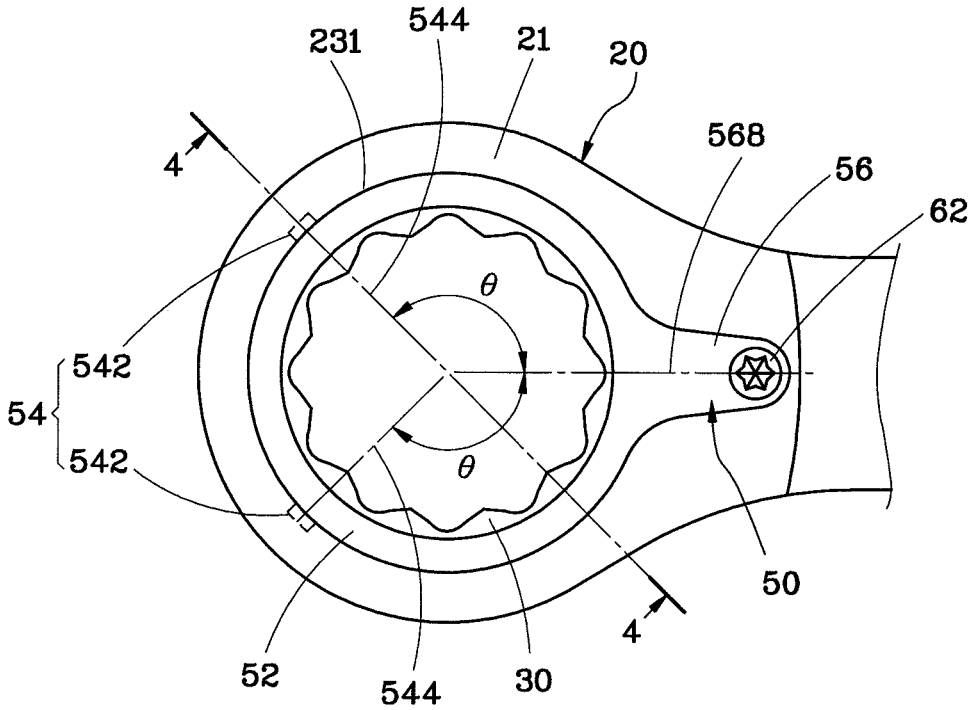
FIG. 3 is a partially top view of the first preferred embodiment of the present invention.
Figure 4:
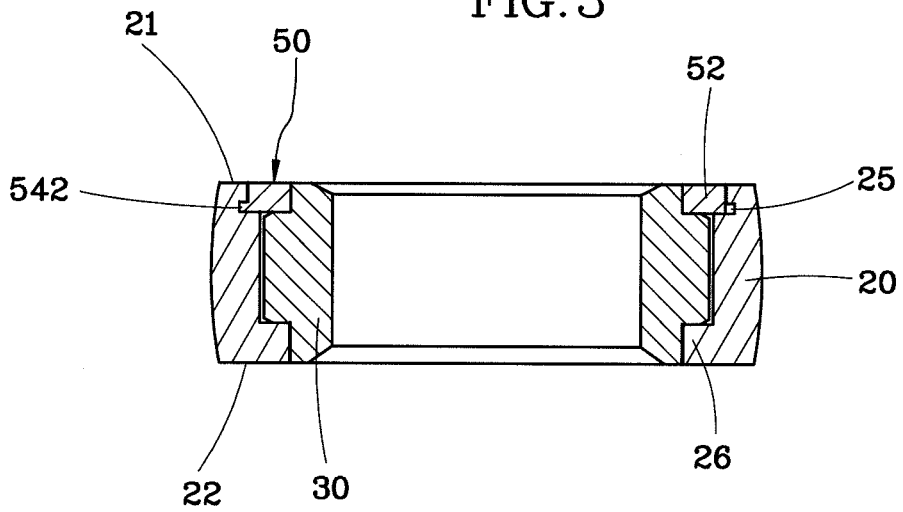
FIG. 4 is a sectional view taken along a line 4-4 indicated in FIG. 3.

In the aforesaid embodiments, the retained portion 54 includes two lugs 542 and as shown in FIG. 3, an obtuse angle θ is defined between an imaginary line 544 passing through a center of each lug 542 and a center of the block portion 52 and an imaginary line 568 passing through a center of the block portion 52 and a center of the fixed portion 56. The imaginary lines 544 are substantially perpendicular to each other. In this way, the cover member 50 can be stably fixed to the main body 20 because the two lugs 542 and the fixed portion 56 spaced from each other in a predetermined interval are limited or fixed.

Figure 9:
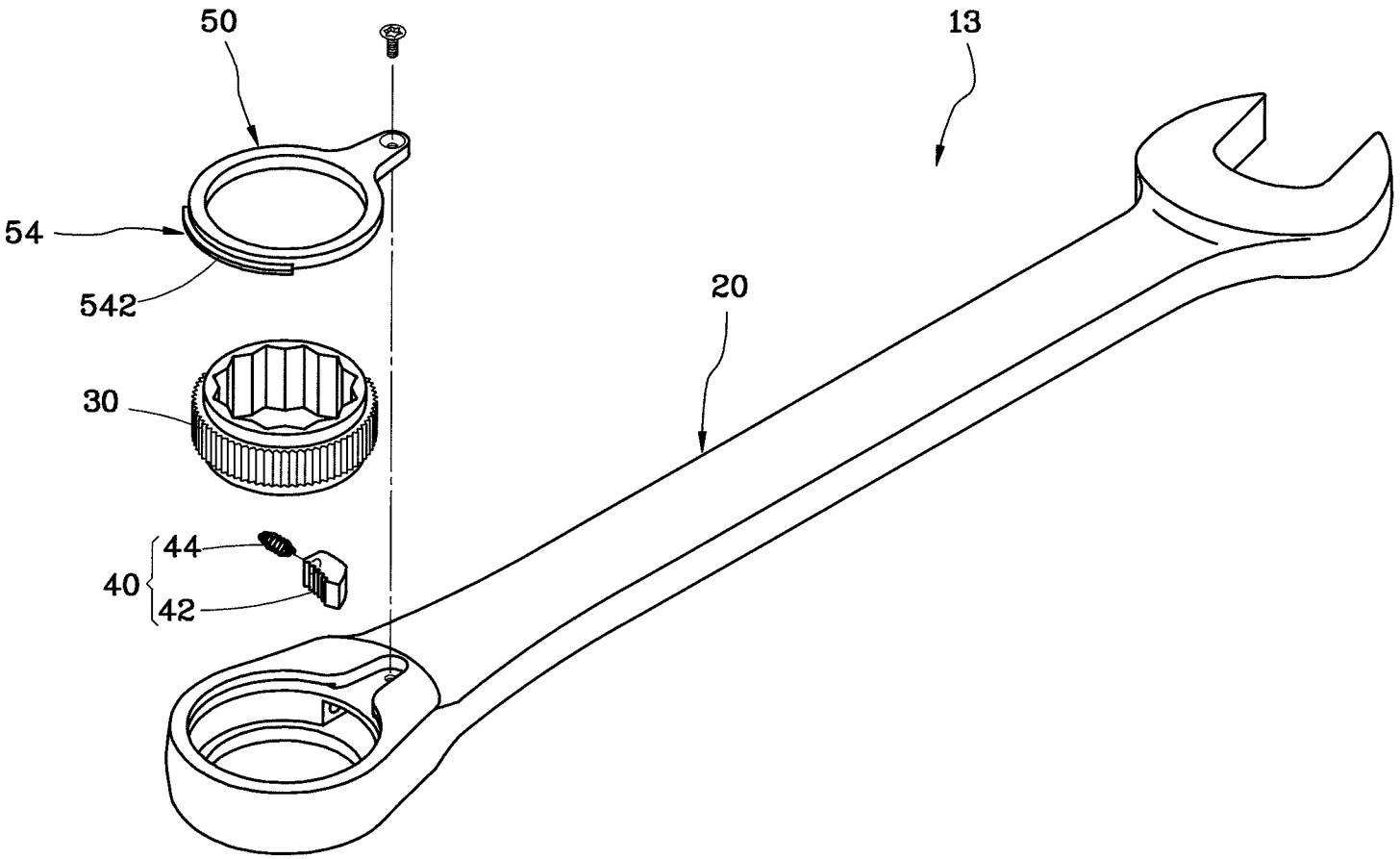
FIG. 9 is an exploded view of a third preferred embodiment of the present invention.
Figure 10:
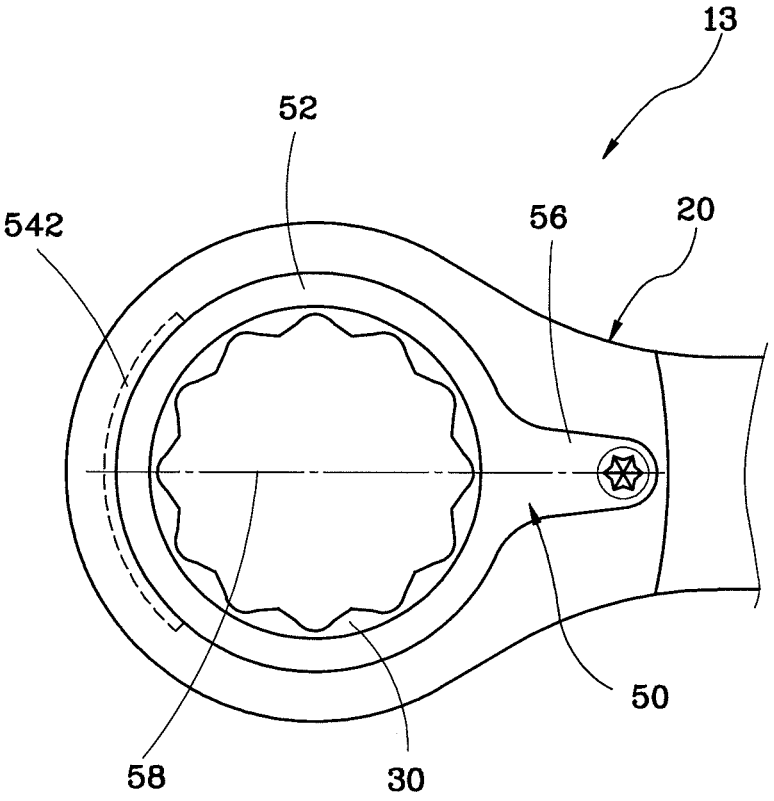
FIG. 10 is a partially top view of the third preferred embodiment of the present invention.

However, the retained portion 54 of the cover member 50 in each of the ratchet wrenches 11 and 12 the two embodiments can be another interchangeable equivalent. For example, referring to FIGS. 9-10, the retained portion 54 of the cover member 50 of a detachable ratchet wrench 13 constructed according to a third preferred embodiment of the present invention includes only one lug 542 having larger area than those of the aforesaid embodiments, and an imaginary straight line can pass through respective centers of the lug 542, block portion 52, and fixed portion 56, as shown in FIG. 10.

Figure 11:
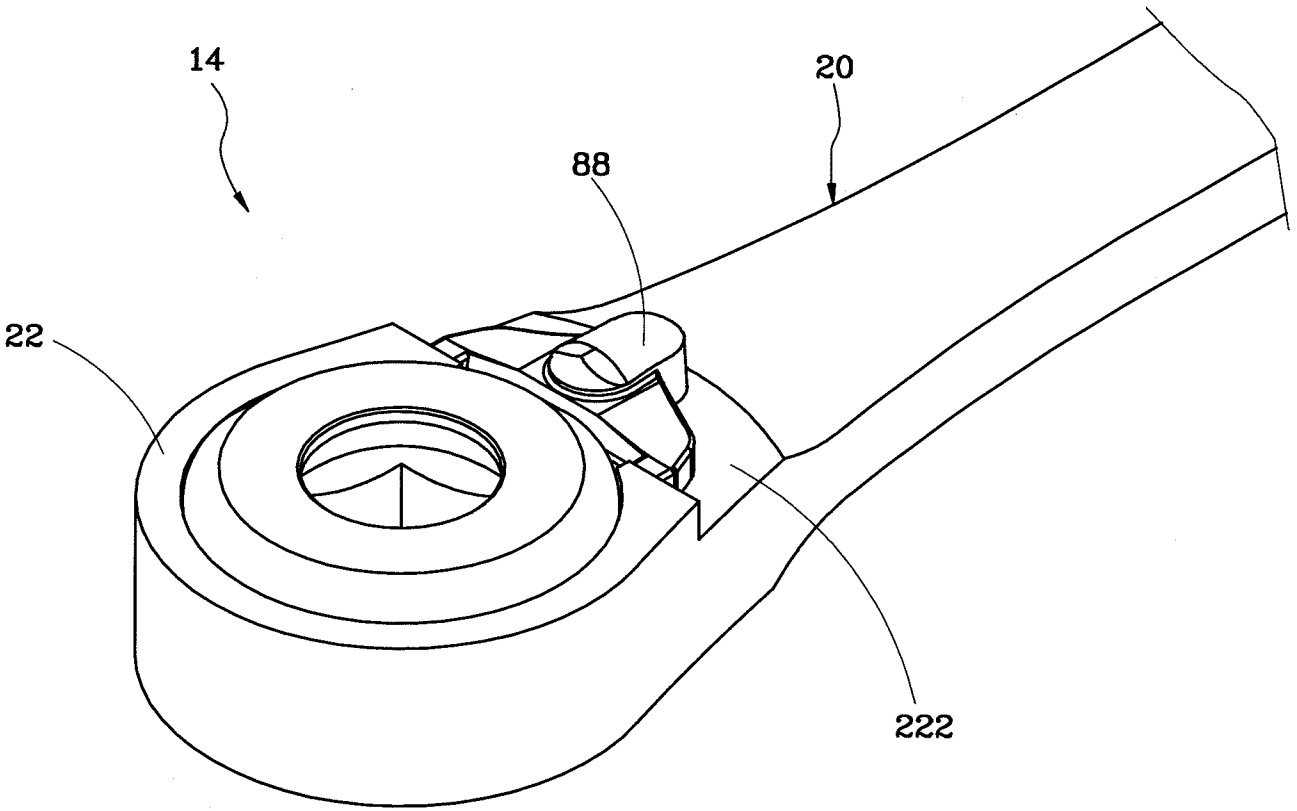
FIG. 11 is a partially perspective view of a fourth preferred embodiment of the present invention.
Figure 12:
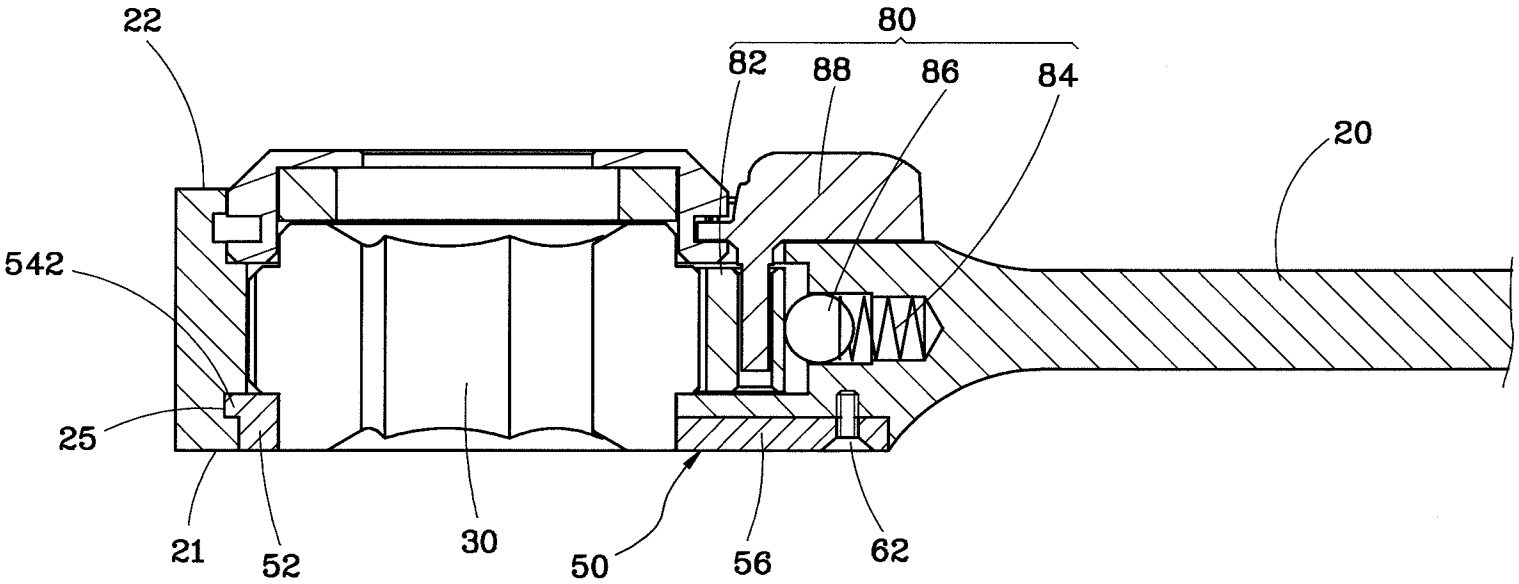
FIG. 12 is a partially sectional view of the fourth preferred embodiment of the present invention.

The detachable ratchet wrenches 11-13 of the three embodiments each are one-way, i.e. the ratchet 30 can only be rotated in one single direction. However, the user's easily detachable structure applied to the detachable ratchet wrenches of the aforesaid embodiments can be also applied to a two-way ratchet wrench, such as a detachable ratchet wrench 14 shown in FIGS. 11-12. The detachable ratchet wrench 14 includes a pawl 82, a springy member 84, a steel ball 86, and a switching member 88. The switching member 88 can allow the user to switch the rotational direction of the ratchet 30 from one to the other to enable the ratchet 30 to be rotated clockwise or counterclockwise; it belongs to the prior art, so further recitation is skipped. Because the cover member 50 is mounted to the first surface 21 of the main body 20, the switching member 88 is mounted to a recessed portion 222 formed on the second surface 22. In other words, as long as the cover member 50 and the switching member 88 are mounted to the opposite sides of the main body 20, the fixed portion 56 and the switching member 88 can be prevented from interference with each other to enable the detachable ratchet wrench 14 to have the features of two-way rotation of the ratchet and detachability of the cover member.

Although the present invention has been described with respect to specific preferred embodiments thereof, it is in no way limited to the specifics of the illustrated structures but changes and modifications may be made within the scope of the appended claims.

What is claimed is:

1. A detachable ratchet wrench comprising:

a main body having a first surface, a second surface, a through hole running through the first and second surfaces, and a groove recessed from the wall of the through hole;

a ratchet mounted inside the through hole; and a cover member mounted to an opening located on the first surface and formed from the through hole for limiting the ratchet into the through hole, the cover member having a block portion, a retained portion, and a fixed portion, the retained and fixed portions protruding outward from the block portion, the block portion being located at the through hole, the retained portion being located inside the groove of the main body, the fixed portion being fixedly connected with the main body via a fastening unit;

wherein the retained portion of the cover member comprises two lugs and an obtuse angle (θ) is defined between an imaginary line passing through a center of each lug and a center of the block portion and an imaginary line passing a center of the block portion and a center of the fixed portion;

wherein the imaginary line passing through the center of one of the two lugs and the center of the block portion is perpendicular to that passing through the center of the other lug and the center of the block portion.

2. The detachable ratchet wrench as defined in claim 1, wherein the main body comprises a threaded hole; the fixed portion comprises a through hole; the fastening unit comprises a screw inserted through the through hole of the cover member to be threaded with the threaded hole of the main body.

3. The detachable ratchet wrench as defined in claim 2, wherein the main body comprises a recession recessed from the first surface and communicating with the through hole of the main body; the threaded hole is located inside the recession; the fixed portion of the cover member are is mounted inside the recession.

4. The detachable ratchet wrench as defined in claim 1, wherein the main body comprises a recession recessed from the first surface and communicating with the through hole of the main body; the fixed portion of the cover member is mounted inside the recession.

5. A detachable ratchet wrench comprising:

a main body having a first surface, a second surface, a through hole running through the first and second surfaces, and a groove recessed from the wall of the through hole;

a ratchet mounted inside the through hole; and a cover member mounted to an opening located on the first surface and formed from the through hole for limiting the ratchet into the through hole, the cover member having a block portion, a retained portion, and a fixed portion, the retained and fixed portions protruding outward from the block portion, the block portion being located at the through hole, the retained portion being located inside the groove of the main body, the fixed portion being fixedly connected with the main body via a fastening unit;

wherein the retained portion of the cover member comprises a lug and an imaginary straight line passes through a center of the lug, a center of the block portion, and a center of the fixed portion.

6. A detachable ratchet wrench comprising:

a main body having a first surface, a second surface, a through hole running through the first and second surfaces, and a groove recessed from the wall of the through hole;

a ratchet mounted inside the through hole; and a cover member mounted to an opening located on the first surface and formed from the through hole for limiting the ratchet into the through hole, the cover member having a block portion, a retained portion, and a fixed portion, the retained and fixed portions protruding outward from the block portion, the block portion being located at the through hole, the retained portion being located inside the groove of the main body, the fixed portion being fixedly connected with the main body via a fastening unit;

wherein the fixed portion of the cover member comprises a contacting surface; the fastening unit comprises a pusher and a springy member, the pusher having two ends, one of which abuts against the contact surface of the fixed portion, the springy member having two ends abutting against the other end of the pusher and the main body, respectively.

7. The detachable ratchet wrench as defined in claim 6, wherein the fixed portion of the cover member further comprises a contacting portion extending outward from the contacting surface to make the fixed portion become stepped; the pusher comprises a first push portion and a second push portion connected with the first push portion to make the pusher become stepped, the first push portion being located on the contacting portion of the fixed portion and abutting against the contacting surface, the second push portion abutting against the contacting portion of the fixed portion and being pushed against by the springy member.

8. The detachable ratchet wrench as defined in claim 7, wherein the main body comprises a recession and a cover portion, the recession being recessed from the first surface and communicating with the through hole of the main body, the cover portion covering a part of the recession to enable the recession to have a receiving portion located below the first surface; the fixed portion of the cover member and the fastening unit are located inside the recession; the springy member is mounted inside the receiving portion.

9. The detachable ratchet wrench as defined in claim 6, wherein the main body comprises a recession and a cover portion, the recession being recessed from the first surface and communicating with the through hole of the main body, the cover portion covering a part of the recession to enable the recession to have a receiving portion located below the first surface; the fixed portion of the cover member and the fastening unit are mounted inside the recession; the springy member is mounted inside the receiving portion.

* * * * *